United States Patent [19]

Sonolet

[11] Patent Number: 4,966,219

[45] Date of Patent: Oct. 30, 1990

[54] SLIDING SHUTTER COMPOSED OF ARTICULATED SLATS, PARTICULARLY FOR FURNITURE

[75] Inventor: Henri C. Sonolet, Paris, France

[73] Assignee: Marcadet Mobilier, Le Blanc Mesnil, France

[21] Appl. No.: 477,597

[22] Filed: Feb. 9, 1990

Related U.S. Application Data

[63] Continuation of Ser. No. 55,242, May 28, 1987, abandoned.

[30] Foreign Application Priority Data

Jun. 17, 1986 [FR] France ..... 86 08750
Nov. 14, 1986 [FR] France ..... 86 15883

[51] Int. Cl.[5] ..... E05D 15/06

[52] U.S. Cl. ..... 160/201; 160/37; 160/236

[58] Field of Search ..... 160/201, 236, 36, 37, 160/19; 312/138 R

[56] References Cited

U.S. PATENT DOCUMENTS 1,251,106 12/1957 Ritter ..... 160/201
3,836,769 9/1974 Wilson ..... 160/201 X
3,837,041 9/1974 Modert et al. ..... 160/201 X

FOREIGN PATENT DOCUMENTS 2421259 3/1978 France ..... 160/201

*Primary Examiner*—Blair M. Johnson
*Attorney, Agent, or Firm*—Bierman and Muserlian

[57] ABSTRACT

A sliding shutter intended in particular for longitudinal movement and comprising a plurality of slats articulated to one another and disposed vertically between two slide guides lying one above the other. The slats are driven by at least two pinions having a plurality of teeth and mounted on a common shaft. The pinions mesh with said articulated slats on the one hand at the recessed structure of the slat, and on the other hand at the spaced formed between the articulation structures of two adjoining slats.

8 Claims, 3 Drawing Sheets

SLIDING SHUTTER COMPOSED OF ARTICULATED SLATS, PARTICULARLY FOR FURNITURE

PRIOR APPLICATION

This application is a continuation of U.S. patent application Ser. No. 055,242 filed May 28, 1987, now abandoned.

The present invention relates to a sliding shutter composed of articulated slats and utilizable in particular for furniture.

In French Patent No. 1,265,938 of the May 25th 1960 and the Certificate of Addition thereto 8974,010 of the Sept. 23rd 1961 the Applicants described and claimed systems of sliding shutters consisting of seamed slats whose profile comprised two complementary rolled edges, one of the rolled edges of a slat being adapted to engage with light friction inside the other rolled edge of an adjacent slat. The sliding shutters produced in this manner from seamed slats disposed vertically between two slide guides lying one above the other were driven by at least a pair of toothed wheels keyed on a common shaft and adapted to mesh with the inside face of the shutter, at least one tooth of each of the wheels always being in mesh with one and the same slat.

Although they undeniably had advantages over sliding shutter systems known at the time, systems of this kind nevertheless did not give satisfaction, particularly because each slat was not presented to the teeth of each wheel in such a manner as to ensure good engagement. Furthermore, jamming occurred when the slats had to negotiate the curved portions of the slide guides.

The present invention seeks to provide a sliding shutter which consists of articulated slats and in which the meshing between the system of articulated slats and the toothed wheel approximates as closely as possible to a chain and pinion type drive.

Another aim of the invention is to provide a sliding shutter consisting of a series of articulated slats and so designed as to permit the passage of the shutter through slide guides having semicircular bends, without any jamming or overlapping of the slats constituting the sliding shutter occurring.

The present invention therefore has as its object a sliding shutter which is in particular intended for horizontal movement and which comprises a plurality of slats articulated to each other and disposed vertically between two slide guides lying one above the other, said slats being driven by two pinions mounted on a common shaft and meshing with said articulated slats, characterized in that each slat has along its vertical axis of symmetry, at least at the point where it meshes with the pinions, a recessed structure closely matching the toothing of said pinions.

The sliding shutter according to the invention is also remarkable for the following points:

the recessed structure is a longitudinal gutter;

the lower slide guide has a support rib for the bottom face of the slats;

the slide guides have undergone surface treatment, for example by the application of graphited nylon.

The shaft on which the pinions are mounted is composed of a hollow square iron bar intended to engage in a locking structure provided in the axis of each of the pinions.

The invention also extends to the articulated slats constituting the sliding shutter. Each articulated slat advantageously comprises a body consisting of a planar rear wall and a front wall having two projecting structures centrally bounding a recessed meshing structure, these two walls joining one another and being laterally extended by articulation structures designed to be articulated to a corresponding structure on the adjoining slat, while an internal bracing structure is provided, which is advantageously disposed longitudinally along the axis of symmetry of the slat and which in conjunction with the front and rear walls imparts appropriate rigidity to the slat, this internal bracing structure also being intended to support the meshing structure, which is advantageously in the form of a gutter extending on each side of the axis of symmetry of the front wall of the slat.

In an alternative embodiment of the present invention advantage is taken of the articulation structures between two adjoining slats in such a manner as to make use of the space existing between said slats as a second meshing structure, the number of teeth of the pinions then being brought to twelve.

The present invention therefore has as its object a sliding shutter consisting of a plurality of slats articulated together, each slat comprising a body composed of a planar rear wall and a front wall having two projecting structures centrally bounding a first recessed structure for meshing with the drive pinions of said sliding curtain, while the lateral articulation structures of each slat form respectively, with the articulation structures of the adjoining slat, a second structure for meshing with said pinions, in order to form a sliding shutter in which the drive pinion or pinions, comprises or comprise twelve teeth.

Thus, either two first meshing structures and a second meshing structure, which are bounded by the articulation structures, or a first meshing structure and two second meshing structures mesh with three pinion teeth, so that the sliding and rotation of the shutter are further facilitated.

According to another characteristic of this alternative embodiment, since the rigidity of the slats is obtained through their double-wall construction, the toothed wheel of each pinion meshes in the middle of the slat with the slat with which it comes into contact as well as with the end side walls bounding said slat.

Other characteristics and advantages of the invention will emerge on perusal of the following description of one non-limitative form of construction of a horizontally moving sliding shutter, with reference to the accompanying drawings, in which.

Figure 1:
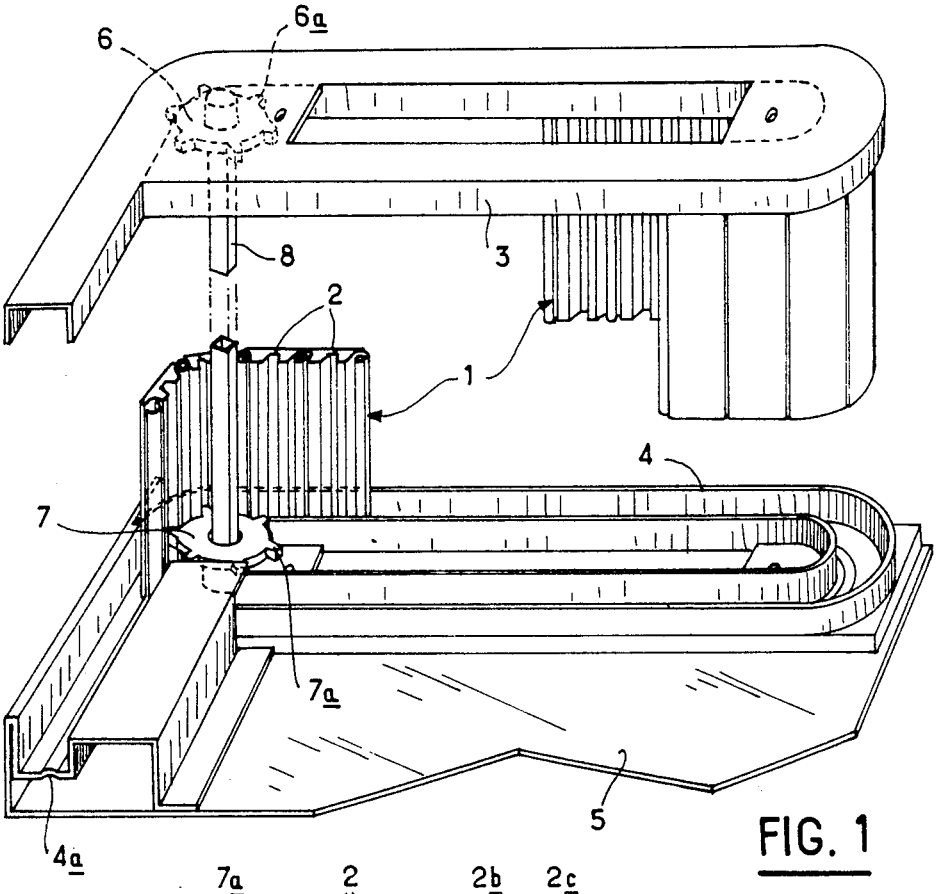
FIG. 1 is a schematic view in perspective, partially broken away, of a sliding shutter according to the invention.

In the embodiment shown in FIG. 1 the sliding shutter 1 is composed of a plurality of slats 2 articulated to one another and disposed vertically between a top slide guide 3 and a bottom slide guide 4, these slide guides advantageously being composed of channel sections open respectively at the bottom and at the top. The slide guide 4 is advantageously fixed on a sheet metal panel 5 constituting the base of a storage cabinet or space. The slide guide 3 is likewise fixed at the top of the cabinet (not shown in the drawings).

The drive device for the shutter 1 is disposed in one of the right angle bends of the cabinet. This drive device consists of a pair of pinions 6 and 7 turning respectively in bearings provided in the slide guides 3 and 4 and mounted on a shaft 8 in the form of a square iron bar, whose geometrical axis coincides with the axis of curvature of the bend and the axis of the pinion bearings. The pinions 6 and 7 carry six teeth, whose profile is adapted to mesh with a gutter 2*a* disposed on each side of the vertical axis of symmetry of each slat 2, which has a planar rear wall and a front wall consisting of two projecting structures 2*e*, 2*f* bounding the gutter 2*a*. This gutter 2*a* bears against a longitudinal bracing structure 2*b* advantageously situated in the vertical axis of symmetry of said slat. On the lateral ends of the slat 2 there are advantageously provided, on the one hand, a pivot 2*c*, and on the other hand a rolled edge 2*d* intended to engage with the pivot 2*c* of the adjacent slat.

Figure 2:
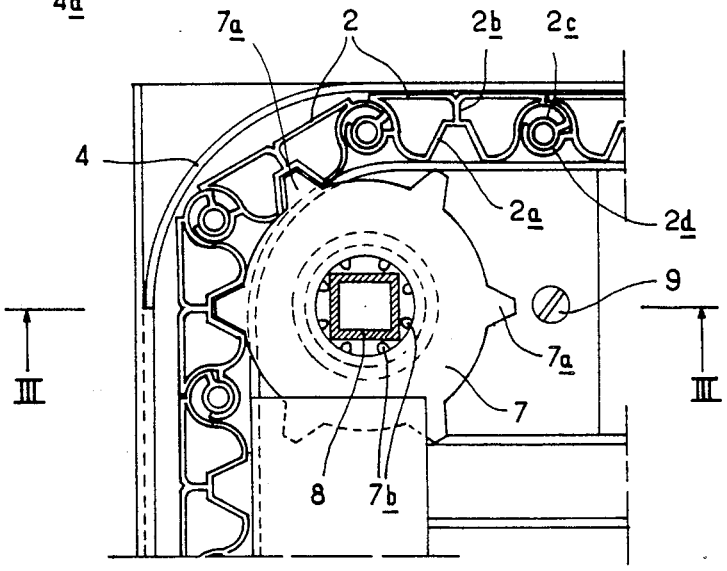
FIG. 2 is a cross-section in a horizontal plane of the sliding shutter in the proximity of the drive device.

As illustrated in FIG. 2, the pinion 7 is provided internally with peripheral ribs 7*b* defining a securing structure for the square iron bar 8; the pinion 6 is similarly provided with a similar securing structure (not shown in the drawings). It can be seen more partucularly from FIG. 2 that the meshing of the teeth 7*a* of the pinion 7 with the gutters 2*a* of the slats 2, said gutters being disposed on the axis of symmetry of said slats, permits a drive of the chain and pinion type in a more refined manner than in previous arrangements. The equilibrium thus obtained in fact permits the movement of the sliding shutter without fear of the jamming or blocking of the slats, this also being due to the advantageous arrangements of the pivots 2*c* and rolled edges 2*d*, which form an articulation closely approximating to the pivot and socket type.

Figure 3:
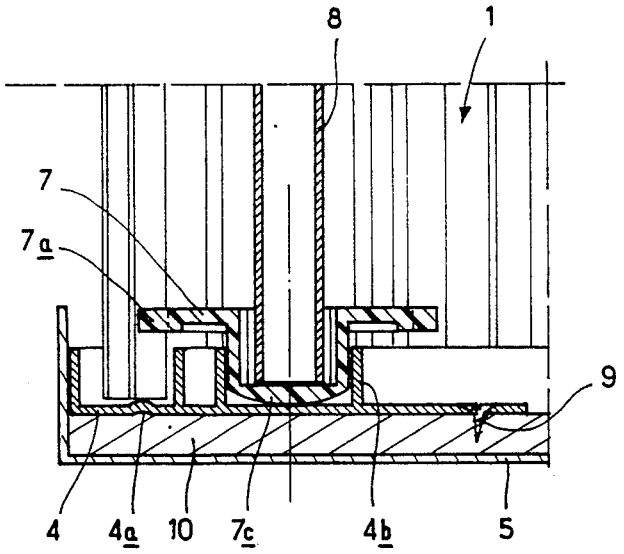
FIG. 3 is a section on the line III—III in FIG. 2.

It will be noted that the slide guide 4 is provided on its bottom with a groove 4*a*, on which the lower face of the slats 2 rests with minimum friction. As shown more particularly in FIG. 3, the pinion 7 is mounted by its shaft 7*c* in a bearing 4*b* provided on the slide guide 4. This slide guide 4 is fastened by a screw 9 on a support plate 10 fixed to the base 5.

Figure 4:
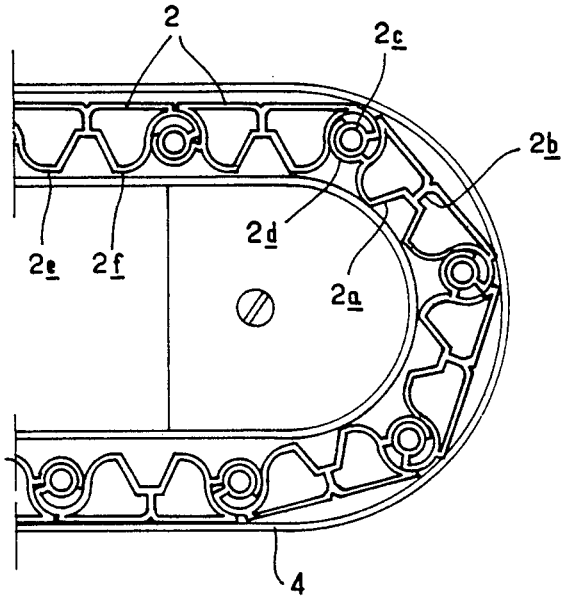
FIG. 4 is a view, to the same scale as FIG. 2, of the hairpin bend of the slide guide shown in FIG. 1.

As shown in FIG. 4, it can be seen that the special arrangements of the slats 2, and of their respective articulation structures 2*c* and 2*d*, enable the sliding shutter of the invention to move in a hairpin type 180° bend.

Figure 5:
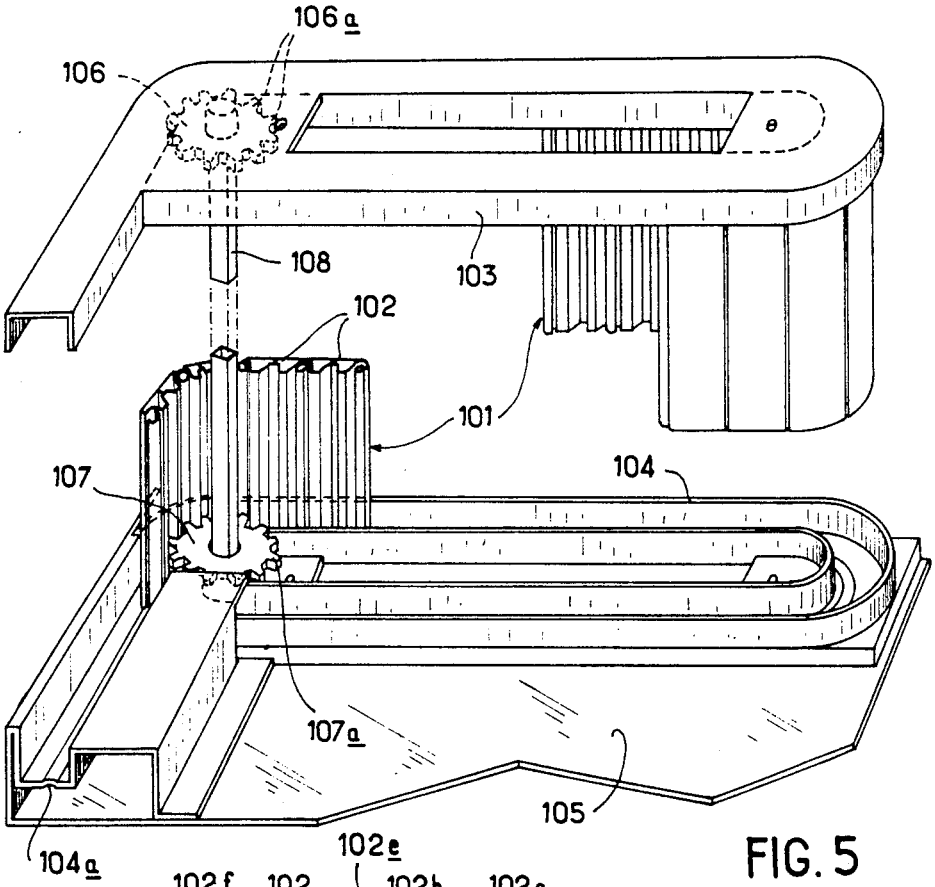
FIG. 5 is a schematic view in perspective, partially broken away, of the alternative form of construction of the sliding shutter according to the invention.
Figure 6:
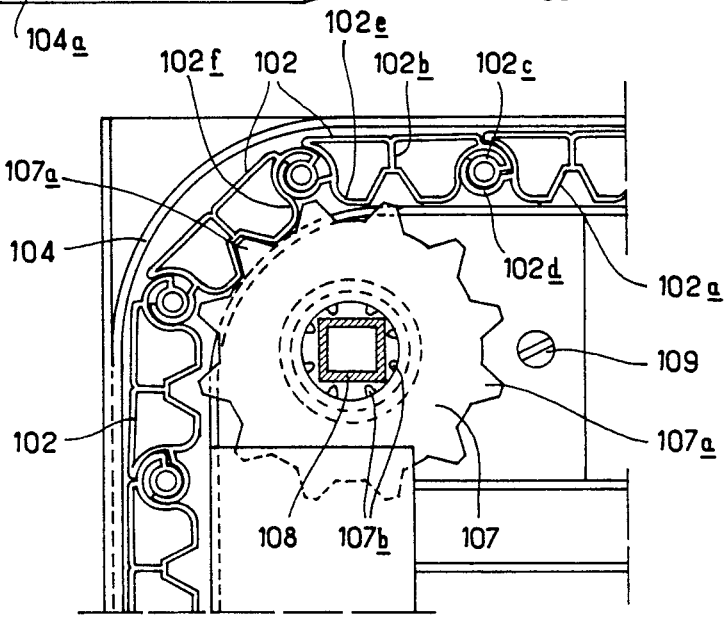
FIG. 6 is a cross section in a horizontal plane of the alternative embodiment shown in FIG. 5, in the proximity of the drive device.

In the alternative embodiment shown in FIG. 5, the sliding shutter 101 is composed of a plurality of slats 102 articulated to one another and disposed vertically between a top slide guide 103 and a bottom slide guide 104, these slide guides advantageously being composed of channel sections open respectively at the bottom and at the top. The slide guide 104 is advantageously fixed on a sheet metal panel 105 constituting the base of a storage cabinet or space. The slide guide 103 is also fixed to the top of a cabinet (not shown in the drawing).

The drive device for the shutter 101 is disposed in one of the right angle bends of the cabinet. This drive device is composed of a pair of pinions 106 and 107 having twelve teeth and turning respectively in bearings provided in the slide guides 103 and 104, said pinions being mounted on a shaft 108 in the form of a square iron bar whose geometrical axis coincides with the axis of curvature of the bend and with the axis of the pinion bearings. The pinions 106 and 107 carry twelve teeth, whose profile is adapted to mesh on the one hand with a gutter 102*a* disposed on each side of the vertical axis of symmetry of each slat 102, which has a planar rear wall and a front wall consisting of two projecting structures 102*e*, 102*f* bounding the gutter 102*a*, and on the other hand with the gutter bounded by the articulation structures 102*c*, 102*d* of two adjoining slats 102. This gutter 102*a*, bears on a longitudinal bracing structure 102*b*, which is advantageously situated in the vertical axis of symmetry of said slat. On the lateral ends of the slat 102 the structures for articulating adjoining slats together are composed, on the one hand, of a pivot 102*c*, and on the other hand of a rolled edge 102*d* intended to engage on the pivot 102*c* of the adjacent slat.

As illustrated in FIG. 2, the pinion 107 is provided internally with peripheral ribs 107*b* defining a structure for securing the square iron bar 8; similarly, the pinion 106 is provided with a securing structure (not shown in the drawings) of the same type. It can be seen more particularly in FIG. 2 that the meshing of the teeth 107*a* of the pinion on the one hand with the gutters 102*a* of the slats 102—which are disposed along the axis of symmetry of said slats, and on the other hand with the gutters bounded by the articulation structures 102*e*, 102*f* of two adjacent slats 102 permits a drive of the chain and pinion type in a more refined manner than in the arrangement according to the first embodiment. The equilibrium thus obtained in fact permits the movement of the sliding shutter without fear of the jamming or blocking of the slats, this also being due to the advantageous arrangements of the pivots 102*c* and rolled edges 102*d*, which form an articulation closely approximating to the pivot and socket type.

It will be noted that the slide guide 104 is provided on its bottom with a groove 104*a*, on which the lower face of the slats 102 rests with minimum friction.

The invention thus solves the problems posed by the effects of poor driving of the slats and their jamming in the slide guides, which problems it had been attempted to solve in devices of the prior art, this solution being due to the association of pinions and slats provided with gutters extending along their longitudinal axis of symmetry and receiving the teeth of the pinions, these slats being in addition provided with two walls associated with an internal bracing structure designed to impart to them rigidity characteristics appropriate to their use.

What is claimed is:

1. A sliding shutter for furniture capable of moving longitudinally without jamming or blocking of the shutter slats made of a plurality of vertical articulated slats disposed between two slide guides lying one above the other, each slat comprising a body consisting of a planar rear wall and a front wall having two projecting structures centrally bounding a recessed meshing structure, these two walls joining one another and being laterally extended by articulation structures designed to be articulated to a corresponding structure on the adjoining slat, while an internal bracing structure is provided which is disposed longitudinally along the axis of symmetry of the slat and which in conjunction with the front and rear walls imparts appropriate rigidity to the slat, this internal bracing structure also being intended to support the meshing structure, said slats being driven by at least two pinions carrying teeth with a profile adapted to mesh with a gutter disposed on each side of the vertical axis of symmetry of each slat mounted on a common shaft and meshing with said articulated slats, each pinion provided with internal peripheral ribs to secure a vertical square bar and said slats having at their lateral ends a pivot and a rolled edge adapted to engage the pivot of the adjacent slat.

2. A sliding shutter as claimed in claim 1, wherein the lower slide guide has a support rib for the bottom face of the slats.

3. A sliding shutter as claimed in claim 1, wherein the slide guides have undergone surface treatment.

4. A sliding shutter as claimed in claim 3, wherein the surface treatment of the slide guides has been carried out by applying graphited nylon thereto.

5. A sliding shutter as claimed in claim 1, wherein the meshing structure is composed of a gutter extending on each side of the axis of symmetry of the slat.

6. A sliding shutter for furniture intended for longitudinal movement without jamming or blocking and comprising a plurality of slats articulated to one another and disposed vertically between two slide guides lying one above the other, said slats being driven by at least two pionions carrying teeth with a profile adapted to mesh with a gutter disposed on each side of the vertical axis of symmetry of each slat mounted on a common shaft and meshing with said articulated slats wherein each slat has along its vertical axis of symmetry at least at the point where it meshes with the pionions, a recessed structure closely matching the toothing of the pinions, each slat comprising a body consisting of a planar rear wall and a front wall having two projecting structures centrally bounding a first recessed structure meshing with the drive pinions of the sliding shutter and lateral articulation structures of each slat forming respectively with the articulation structures of an adjoining slat, a second structure for meshing with said pinions and the drive pinions having 12 teeth, each pinion provided with internal peripheral ribs to secure a vertical square bar and said slats having at their lateral ends a pivot and a rolled edge adapted to engage the pivot of the adjacent slat.

7. A sliding shutter as claimed in claim 6, wherein either two first meshing structures (b) and a second meshing structure bounded by the articulation structures or a first meshing structure and two second meshing structures mesh with three pinion teeth.

8. A sliding shutter as claimed in claim 6, wherein, the rigidity of the slats having side walls due to their double-wall construction enables the toothed wheel of each pinion to mesh with the middle of the slat with which it comes into contact and with the end side walls bounding said slat.

* * * * *